US011690399B2

(12) United States Patent
Lavanchy et al.

(10) Patent No.: US 11,690,399 B2
(45) Date of Patent: Jul. 4, 2023

(54) RETRACTABLE HEAT SOURCE FOR AEROSOL GENERATING ARTICLE

(71) Applicant: PHILIP MORRIS PRODUCTS S.A., Neuchatel (CH)

(72) Inventors: Frédéric Lavanchy, Chavornay (CH); Alexandre Malgat, Les Tuileries de Grandson (CH); Ali Murat Saygili, Neuchâtel (CH)

(73) Assignee: Philip Morris Products, S.A., Neuchatel (CH)

( * ) Notice: Subject to any disclaimer, the term of this patent is extended or adjusted under 35 U.S.C. 154(b) by 640 days.

(21) Appl. No.: 16/066,914

(22) PCT Filed: Dec. 13, 2016

(86) PCT No.: PCT/IB2016/057579
§ 371 (c)(1),
(2) Date: Jun. 28, 2018

(87) PCT Pub. No.: WO2017/115196
PCT Pub. Date: Jul. 6, 2017

(65) Prior Publication Data

US 2019/0000142 A1 Jan. 3, 2019

(30) Foreign Application Priority Data

Dec. 30, 2015 (EP) ..... 15203127

(51) Int. Cl.
*A24F 47/00* (2020.01)
*A24D 3/17* (2020.01)
*A24D 1/22* (2020.01)

(52) U.S. Cl.
CPC *A24D 3/17* (2020.01); *A24D 1/22* (2020.01)

(58) Field of Classification Search
None
See application file for complete search history.

(56) References Cited

U.S. PATENT DOCUMENTS 2,779,340 A 1/1957 Mansfield
4,116,204 A 9/1978 Kline
(Continued)

FOREIGN PATENT DOCUMENTS

CA 2936160 12/2015
CN 2478371 Y 2/2002
(Continued)

OTHER PUBLICATIONS

Notification for the Opinion of Examination Intellectual Property Office Ministry of Economic Affairs, dated Mar. 23, 2020 for Application No. 105143353, 10 pgs. including translation.
(Continued)

*Primary Examiner* — Phu H Nguyen
(74) *Attorney, Agent, or Firm* — Mueting Raasch Group

(57) ABSTRACT

An aerosol generating article (100) includes a retractable heat source (130). The aerosol generating article has a tubular body (110) positioned at the proximal end (102) of the aerosol generating article. A combustible heat source is positioned at the distal end (104) of the aerosol generating article. An aerosol generating substrate (120) is downstream of the combustible heat source. The combustible heat source is slideable from an extended position to a retracted position having a shorter article length. An entire length of the combustible heat source retracts into the tubular body in the retracted position.

20 Claims, 2 Drawing Sheets

(56) References Cited

U.S. PATENT DOCUMENTS

| | | | | |
|---|---|---|---|---|
| 5,033,483 | A * | 7/1991 | Clearman | A24D 1/22 131/194 |
| 5,040,552 | A | 8/1991 | Schleich et al. | |
| 5,285,798 | A | 2/1994 | Banerjee et al. | |
| 5,595,577 | A | 1/1997 | Bensalem et al. | |
| 5,992,420 | A * | 11/1999 | Moriyama | A24D 1/10 131/187 |
| 2015/0027475 | A1 * | 1/2015 | Jarriault | A24D 3/04 131/329 |

FOREIGN PATENT DOCUMENTS

| | | | |
|---|---|---|---|
| CN | 1382402 | A | 12/2002 |
| CN | 201467987 | U | 5/2010 |
| CN | 103720037 | A | 4/2014 |
| CN | 103932390 | | 7/2014 |
| EP | 2 550 879 | A1 | 1/2013 |
| EP | 2 954 792 | A1 | 12/2015 |
| JP | S52143167 | A | 11/1977 |
| WO | WO 2009/022232 | A2 | 2/2009 |

OTHER PUBLICATIONS

International Search Report and Written Opinion for PCT/IB2016/057579, issued by the European Patent Office, dated Mar. 14, 2017; 13 pgs.

Chinese Office Action issued by the China National Intellectual Property for CN 201680070487.8, dated Jun. 28, 2020; 20 pgs.

Japanese Office Action for JP 2018534701 issued by the Japanese Patent Office dated Feb. 25, 2021; 10 pgs. including English translation.

Third Chinese Office Action for CN Application No. 201680070487.8 issued by the China National Intellectual Property Administration dated Dec. 16, 2021; 23 pgs. including English translation.

* cited by examiner

RETRACTABLE HEAT SOURCE FOR AEROSOL GENERATING ARTICLE

This application is the § 371 U.S. National Stage of International Application No. PCT/IB2016/057579, filed 13 Dec. 2016, which claims the benefit of EP Patent Application No. 15203127.4, filed 30 Dec. 2015, the disclosures of which are incorporated by reference herein in their entireties.

This disclosure relates to an aerosol generating article having a combustible heat source for heating an aerosol-forming substrate.

A number of smoking articles in which tobacco is heated rather than combusted have been proposed in the art. An aim of such 'heated' smoking articles is to reduce certain smoke constituents of the type produced by the combustion and pyrolytic degradation of tobacco in conventional cigarettes. In one known type of heated smoking article, an aerosol is generated by the transfer of heat from a combustible heat source to a physically separate aerosol-forming substrate, for example containing tobacco. The aerosol-forming substrate may be located within, around or downstream of the combustible heat source. For example, WO-A2-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate. During use, volatile compounds are released from the aerosol-forming substrate by heat transfer from the combustible heat source and entrained in air drawn through the smoking article. As the released compounds cool, they condense to form an aerosol that is inhaled by the user.

Aerosol generating articles which include a combustible fuel element or heat source may have a combustion zone or zone of heating that is larger, more dense, and not as readily extinguished by crushing or "stubbing out" the heat source compared to for example a conventional cigarette, in which tobacco is burnt or combusted to heat and release volatile compounds from the tobacco. Such aerosol generating articles may have a heat source that contains significantly more energy in the form of heat than found in the combustion zone of a conventional cigarette. Consequently, such aerosol generating articles may require more effort to extinguish or to remove heat to facilitate disposal.

It would be desirable to provide an extinguisher for an aerosol generating article that can conveniently facilitate extinguishment of a combustible heat source on demand. It would be desirable that this extinguishment be accomplished with a "stubbing out" motion that is associated with extinguishing a conventional cigarette. In addition, it would be desirable to provide an extinguisher that can be simple to manufacture and use and which can be kept unobtrusively together with the aerosol generating article so as to avoid the need of having a separate element to extinguish the aerosol generating article following use.

According to an aspect of the invention, an aerosol generating article extends from a proximal end to a distal end. A tubular body is positioned at the proximal end of the aerosol generating article and extends toward the distal end. A combustible heat source is positioned at the distal end of the aerosol generating article. An aerosol generating substrate is downstream of the combustible heat source. The combustible heat source is slideable from an extended position to a retracted position having a shorter article length. The combustible heat source at least partially retracts into the tubular body in the retracted position, preferably an entire length of the heat source retracts into the tubular body in the retracted position.

Advantageously, the combustible heat source at least partially or entirely retracts into the tubular body. In this way, the tubular body may modulate the amount of airflow to the combustible heat source on demand. The tubular body may include a heat reactive material. Such a material may seal and secure the combustible heat source once in the retracted position. The tubular body may include a heat insulating material. Such material may retain at least some of the heat within the aerosol generating article until the combustible heat source is extinguished and cooled. Thus, the heat source may be shielded by the tubular body until it has cooled to reduce potential risk associated with improper handling of the aerosol generating article.

In some embodiments, the aerosol generating article includes a filter element that may be partially disposed within the proximal end of the tubular body. This filter element may be slideable from an extended position to a retracted position into the tubular body. Retracting both of the combustible heat source and the filter element into the tubular body may further reduce the retracted length of the aerosol generating article for disposal.

Preferably a retention element maintains the extended position of the combustible heat source until sufficient force is applied to the combustible heat source to overcome the retention element and retract the combustible heat source into the tubular element. Providing such an retention element may prevent the combustible heat source from retracting accidentally, and so positive action or force is required from the user to move the combustible heat source away from the extended position. This positive force may mimic the 'stubbing out' ritual motion and reduced length associated with extinguishing conventional smoking articles.

Embodiments that include a retractable filter element may also include an retention element to maintain the extended position of the filter element until sufficient force is applied to the filter element to overcome the retention element and retract the filter element into the tubular element.

According to an aspect of the invention, the aerosol generating article may further include an inner tubular member holding the combustible heat source. The inner tubular member is at least partially disposed within the distal end of the tubular body and the inner tubular member is slideable from the extended position to the retracted position. The inner tubular member may optionally hold the aerosol-forming substrate and one or more filter, diffuser, or transfer elements.

Advantageously, the inner tubular member provides a convenient assembly element for manufacturing the aerosol generating article. The inner tubular member may also be configured to engage the retention element, when present, to maintain the extended position.

The term "aerosol-forming substrate" refers to a substrate capable of releasing, upon heating, volatile compounds, which may form an aerosol. The aerosols generated from aerosol-forming substrates of articles according to the invention may be visible or invisible and may include vapours (for example, fine particles of substances, which are in a gaseous state, that are ordinarily liquid or solid at room temperature) as well as gases and liquid droplets of condensed vapours.

The terms 'distal', 'upstream' and 'front', and 'proximal', 'downstream' and 'rear', are used to describe the relative positions of components, or portions of components, of the aerosol generating article. Aerosol generating article according to the invention comprise a proximal end through which, in use, an aerosol exits the aerosol generating article for delivery to a user. The proximal end of the aerosol generating article may also be referred to as the mouth end. In use, a user draws on the proximal end of the aerosol generating article in order to inhale an aerosol generated by the aerosol generating article.

The term 'intumescent material' refers to a material that expands as a result of heat exposure, thus increasing in volume and decreasing in density.

The term 'heat shrink material' refers to a material that shrinks as a result of heat exposure.

The term "carbonaceous" refers to a material that comprises carbon.

The term "carbon-based" refers to a material comprises primarily of carbon or at least about 50% carbon, by dry weight of material.

This disclosure relates to an aerosol generating article having a combustible heat source for heating an aerosol-forming substrate. The combustible heat source is retractable into a tubular body of the aerosol generating article. In an extended position the combustible heat source is positioned at the distal end of the aerosol generating article. In a retracted position the combustible heat source is at least partially or entirely retracted into the tubular body of the aerosol generating article. The tubular body is configured to modulate or reduce the amount of air entering the combustible heat source and may extinguish the combustible heat source. Preferably the tubular body extends over the entire combustible heat source length in the retracted position to reduce the air supply to the combustible heat source.

The proximal end of the tubular body is an aerosol outlet. The proximal end of the tubular body may be configured as a mouthpiece. In alternative embodiments, the proximal end of the tubular body may be configured to be inserted into a reusable mouthpiece or holder article.

The combustible heat source is slideable from the extended position having a first article length, to a retracted position having a second article length that is less than the first article length. The second article length may be about 90% or less than the first article length, or about 80% or less than the first article length, or about 70% or less than the first article length. The second article length may be in a range from about 40% to about 90% or from about 50% to about 80% of the first article length. The aerosol generating article may reduce in length by at least the length of the combustible heat source. The reduced length of the retracted aerosol generating article may mimic the reduced length of a consumed conventional smoking article.

The aerosol generating article may further include an inner tubular element holding the combustible heat source. The inner tubular element may be at least partially disposed within the distal end of the tubular body and the inner tubular element may be slideable from the extended position to the retracted position. The inner tubular element may have an outer diameter that may be substantially similar to the interior diameter of the tubular body. This configuration may provide a limited gap and a friction fit between the tubular body and the inner tubular element may be slideably disposed in the tubular body. The gap between the tubular body and the inner tubular element may be preferably less than about 1 mm or less than about 0.5 mm.

The inner tubular element may be configured to hold or at least partially contain the aerosol-forming substrate. The inner tubular element may have a barrier separating the aerosol-forming substrate from the combustible heat source and may be referred to as a "blind" heat source, as described below. The aerosol-forming substrate may thus be coupled to the combustible heat source and be slideable with the inner tubular element and the combustible heat source. One or more filters or diffusers or transfer elements may also be contained within or held with the inner tubular element. Likewise the one or more filters or diffusers or transfer elements may be slideable with the inner tubular element and the combustible heat source. The one or more filters or diffusers or transfer elements may be downstream from the aerosol-forming substrate. The inner tubular element may include apertures or perforations to permit air to be drawn into the heated aerosol-forming substrate. The air may be the carrier for the formed aerosol that travels through the aerosol generating article. The inner tubular element may include an area of weakness to allow the aerosol generating article to collapse to the retracted position.

The tubular body may include a retention element that maintains the extended position until sufficient force overcomes the retention element and retracts the combustible heat source into the tubular body to the retracted position. The retention element cooperates with both the inner tubular element and the tubular body to hold these elements in relative position in the extended position. The retention element may provide a friction or interference fit, or the retention element may provide an adhesive connection.

The retention element may be an outer wrapper that may overwrap the junction of the tubular body with the inner tubular element. The retention outer wrapper may be a separate layer that overlays an outer wrapper covering the tubular body. The retention outer wrapper may form a portion of the outer wrapper covering the tubular body. This retention outer wrapper may maintain the aerosol generating article in the extended position during consumption of the aerosol generating article. The retention outer wrapper may break or rupture when sufficient force is applied to the inner tubular element to retract the inner tubular element and combustible heat source into the tubular body. The outer wrapper may be formed of paper or a film of plastic material.

The tubular body may include a detent element to provide an interference fit that maintains the extended position until sufficient force overcomes the detent element and retracts the combustible heat source into the tubular body to the retracted position. The detent element may be a raised rib element circumferentially disposed on the inner surface of the tubular body. The detent element may have a height of less than about 1.5 mm or less than about 1 mm or have a height in a range from about 0.1 to about 1 mm. The detent element may have a width in a range from about 0.1 to about 1 mm.

In some embodiments an adhesive material fixes the combustible heat source or inner tubular element to the tubular body in the extended position. During use, the heat from the combustible heat source may weaken the adhesive material to facilitate the retraction of the combustible heat source or inner tubular element into the tubular body. Upon cooling, the adhesive material may fix the retracted combustible heat source or inner tubular element within the tubular body. The adhesive material may be a thermoplastic material or a pressure sensitive adhesive, and the like. The adhesive material may replace, or be in addition to, the detent or interference element described herein.

Likewise, an adhesive material may fix the extended mouthpiece filter element to the tubular body. During use, the heat from the combustible heat source may weaken the adhesive material to facilitate the retraction of the filter element into the tubular body. Upon cooling, the adhesive material may fix the retracted filter element within the tubular body. The adhesive material described herein may be a thermoplastic adhesive or a pressure sensitive adhesive, and the like.

When the inner tubular element is present, it may be preferable that the inner tubular element be configured to engage the retention element to maintain the extended position until sufficient force is applied to the inner tubular body to overcome the retention element and retracts the combustible heat source into the tubular body. Preferably the inner tubular element has a proximal end that abuts the retention element and maintains the extended position until sufficient force overcomes the retention element (for example, deforming the inner tubular member and passing the proximal end over a detent element) and retracts the inner tubular member and attached combustible heat source into the tubular body to the retracted position.

The combustible hear source may be preferably cylindrical shaped and may be coaxial with the tubular body. In the retracted position the tubular body may surround at least about 50% of the outer curved surface area of the combustible heat source, or at least about 75% of the outer curved surface area of the combustible heat source, or at least about 90%, or preferably 100% of the outer curved surface area of the combustible heat source. In the retracted position the tubular body may contain the combustible heat source. In the retracted position the tubular body may protect the combustible heat source. In the retracted position the tubular body may reduce the air supply and may extinguish the combustible heat source.

In the retracted position, the gap between the combustible heat source and the tubular body may be preferably minimized to restricted access of oxygen to the heat source as compared to when the heat source is free to burn in the extended position. In the retracted position the gap between the combustible heat source and the tubular body may be preferably less than about 2 mm or less than about 1 mm or less than about 0.5 mm.

The distal end region of the tubular body may include a heat reactive material. Preferably the heat reactive material may be disposed on or forms the inner surface of the distal end region of the tubular body. The heat reactive material may be on the distal end region defining a length of about 5 mm to about 15 mm from the distal end of the tubular body. In examples, the heat reactive material may be only on the inner surface distal end region defining a length of about 5 mm to about 15 mm from the distal end of the tubular body.

The heat reactive material may be configured to deform in response to heat from the combustible heat source in the retracted position, such that the tubular body fits tightly (leaving a gap of less than about 1 mm or less than about 0.5 mm) against the combustible heat source. Such an arrangement may enable the tubular body to substantially seal the combustible heat source from an air supply to reduce, even further, the time taken for the heat source to become extinguished. In addition, the heat reactive material may act as an improved thermal barrier between the heat source and the external surface of the tubular body. Therefore, the temperature of the external surface of the aerosol generating article may be reduced.

The heat reactive material may comprise an intumescent material. The heat reactive material may comprise a heat-shrink material. Preferably, the heat-shrink material may be configured to deform the tubular element to further reduce the supply of air to the combustible heat source.

The intumescent material may comprise any suitable material or materials. The intumescent material may form insulating foam when exposed to heat from the retracted combustible heat source. In one embodiment, the intumescent material comprises a carbon source, such as starch or one or more pentaerythritols (or other types of polyalcohol), an acid source, such as ammonium polyphosphate, a blowing agent such as melamine, and a binder, such as soy lecithin. In an alternative embodiment, the intumescent material comprises a mixture of sodium silicate and graphite such that a hard char foam may be produced when the intumescent material is exposed to heat from the retracted combustible heat source.

The intumescent material may be applied as a heat reactive coating formed by applying one or more intumescent varnishes, paints, lacquers, or any combination thereof on an interior surface of the tubular body. For example, by brushing, rolling, dipping or spraying or by using intumescent paper or plastic-based sheet that may be formed into the final shape of the tubular body by any known manufacturing processes, such as cutting, rolling and gluing systems. In one embodiment, the intumescent material may be a latex solution applied by spraying.

The intumescent material may expand by any suitable amount when exposed to heat from the retracted combustible heat source. Preferably, the intumescent material expands by a factor of between about 10 and about 100 times its original dimensions when exposed to heat. The intumescent material may for example have an expansion ration of at least 1.5:1, preferably from about 2:1 to about 5:1; most preferably about 3:1.

Where the intumescent material is applied as a heat reactive coating on an interior surface of the tubular body, preferably the thickness of the coating may be from about 10 micrometers to about 100 micrometers, preferably from about 0.01 mm to about 0.04 mm, more preferably has a minimum thickness of about 0.02 mm. The intumescent material may for example increase from about 0.02 mm to about 1 mm, for example from about 0.05 to about 0.2 mm or more when exposed to heat from the retracted combustible heat source.

Alternatively, or in addition, the heat reactive material may comprise a heat shrink material. The heat shrink material may be a mechanically expanded polymer layer which returns to its unexpanded dimensions as a result of heat exposure from the retracted heat source. For example, the heat shrink material may be manufactured from a thermoplastic material such as nylon, polyolefin, fluroropolymer (such as FEP, PTFE or Kynar), PVC, neoprene, silicone elastomer, Viton, or any combination thereof. In certain embodiments, the heat shrink material may be a fluoroplastic Kynar with a shrink temperature of about 135° C. and a shrink ratio of about 2:1. In such embodiments, the fluoroplastic Kynar may be provided as a layer of the material used to form the tubular body.

The heat shrink material may be applied as a heat reactive coating on an inner surface of the tubular body. In such embodiments, the coating may be applied by any suitable method. For example, the coating may be applied as a sheet or film which may be adhered to the tubular body, for example by gluing or welding.

The heat reactive coating may only be adhered to the distal end region of the tubular body, such that the amount by which the opening of the tubular body may be deformed is increased to more effectively surround or enclose the retracted combustible heat source. It may also allow a layer of air to form between the tubular body and the retracted combustible heat source to improve the thermal insulating properties of the tubular body.

Alternatively, or in addition, the tubular body may be lined with non-combustible material. The non-combustible material may be at least one of: a metal; a metal oxide; a ceramic; or a stone. Further, the non-combustible material may be graphite, carbon fibre or glass fibre material. In other embodiments the tubular body may be formed of wood.

During use of the aerosol generating article, the combustible heat source may reach high temperatures. For example, a heat source of an aerosol generating article may reach an average temperature of around 500° Celsius and in certain cases the temperature of the heat source may reach up to about 800° Celsius. Thus, the tubular body may comprise insulating material. The insulating material may reduce the risk of the user being exposed to high surface temperatures near the heat source on the aerosol generating article. Suitable thermally insulating materials have a low thermal conductivity or substantially no thermal conductivity. Suitable thermally insulating materials may include, for example, cardboards, foams, polymers or ceramic materials, or other materials that have a low thermal conductivity.

The tubular body may comprise heat-sensitive ink, such that, in use, the heat-sensitive ink indicates the temperature of the retracted combustible heat source. The heat-sensitive ink, or thermochromatic pigments or materials change colour with respect to temperature. This has the advantage of providing a user with a visual cue of the temperature near the heat source on the aerosol generating article. Furthermore, the use of a thermochromatic pigment or material may provide a simple visual indication of when the aerosol generating article has reached a temperature that may be low enough to be disposed of without additional precautionary measures.

The tubular element may be formed from a suitable barrier material such as a substantially non-combustible material or a substantially flame retardant material. Preferably, the barrier material may be thermally stable in air at the highest temperature achieved by the heat source of the smoking article. Suitable barrier materials may, for example, include metallic materials, or ceramic materials.

The tubular body may comprise one or more materials that undergo a phase change when heated. The tubular body may comprise one or more materials that melt and extinguish the retracted heat source by flowing over the heat source and eliminating or restricting oxygen supply to the heat source. The tubular body may comprise one or more materials that undergo an endothermic reaction or phase change and consume heat energy produced by the retracted heat source, thereby cooling the retracted heat source. The tubular body may comprise one or more materials that decompose when brought in contact with the retracted heat source and produce a decomposition product that extinguishes the retracted heat source. Examples of materials that may undergo a phase change when in proximity to the heat source include, for example, certain polymers and waxes.

The tubular body may comprise one or more materials selected from the group consisting of barrier materials, non-combustible materials, flame retardant materials, thermally conductive materials, thermally insulating materials, foam materials, phase-changing materials, metallic materials, and ceramic materials. For example, the tubular body may comprise one or more materials selected from the group consisting of non-combustible materials, flame-retardant materials, thermally conductive materials and thermally insulating materials.

The tubular body may comprise a heat-reflective material which advantageously may modulate the heat radiating from the retracted combustible heat source. As used herein the term 'heat reflective material' refers to a material that has a relatively high heat reflectivity and a relatively low heat emissivity such that the material reflects a greater proportion of incident radiation from its surface than it emits. Preferably, the material reflects more than 50% of incident radiation, more preferably more than 70% of incident radiation and most preferably more than 75% of incident radiation.

The tubular body may be formed from a composite material, such as a material comprising a plurality of layers. The layers of the composite material for the tubular body may be formed from two or more of the materials described herein. For example, the tubular body may be formed from material comprising an external insulating layer, a second layer of intumescent or heat reactive material, and an internal layer of non-combustible material.

The tubular body may reduce the emission of undesirable odours from the aerosol generating article when in the retracted position. The tubular body may reduce the emission of odours by comprising a material which absorbs or adsorbs the odours. Alternatively, or in addition, the tubular body may comprise a heat-released flavour compound. The flavour compound may be a nanoparticle formed from a low melting point wax encapsulating the flavour compound. The flavour compound may be preferably volatile such that it is released into the atmosphere on activation of the nanoparticle.

The combustible heat source may be preferably a carbonaceous heat source having a carbon content of at least about 35 percent, more preferably of at least about 40 percent, most preferably of at least about 45 percent by dry weight of the combustible heat source. Where the combustible heat source may be a carbonaceous heat source, the combustible heat source may be formed from one or more suitable carbon-containing materials and may define a solid element or solid monolithic element.

The combustible heat source may be a combustible carbon-based heat source having a carbon content of at least about 50 percent. For example, the combustible heat source may be a combustible carbon-based heat source having a carbon content of at least about 60 percent, or at least about 70 percent, or at least about 80 percent by dry weight of the combustible heat source.

One or more binders may be combined with the one or more carbon-containing materials to form the carbonaceous heat source. The combustible heat source may comprise one or more organic binders, one or more inorganic binders or a combination of one or more organic binders and one or more inorganic binders.

Instead of, or in addition to one or more binders, the combustible heat source may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidizers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$). Combustible heat sources for aerosol generating articles and methods for producing such heat sources are known in the art and described in, for example, U.S. Pat. Nos. 5,040,552 and 5,595,577.

Preferably, the combustible heat source has an apparent density of between about 0.8 g/cm$^3$ and about 1.1 g/cm$^3$. Preferably, the combustible heat source has a mass of between about 300 mg and about 500 mg, more preferably of between about 400 mg and about 450 mg. Preferably, the combustible heat source has a length of between about 7 mm and about 17 mm, more preferably of between about 7 mm and about 15 mm, most preferably of between about 7 mm and about 13 mm. Preferably, combustible heat sources according to the invention have a diameter of between about 5 mm and about 9 mm, more preferably of between about 7 mm and about 8 mm.

As used herein, the term 'diameter' denotes the maximum dimension in the transverse direction of the combustible heat source or aerosol generating article. As used herein, the terms 'radial' and 'transverse' are used to describe the direction perpendicular to the longitudinal direction. That is, the direction perpendicular to the direction between the opposed front and rear faces of the combustible heat source and the proximal end and the opposed distal end of the aerosol generating article.

Preferably, the combustible heat source may be of substantially uniform diameter. However, the combustible heat source may alternatively be tapered such that the diameter of one of the front end face and the rear end face of the combustible heat source may be greater than the diameter of the other of the front end face and the rear end face thereof. For example, combustible heat sources may be tapered such that the diameter of the rear end face of the combustible heat source may be greater that the diameter of the front end face of the combustible heat source. Preferably, the combustible heat source may be substantially cylindrical. The combustible heat source may be a cylindrical combustible heat source of substantially circular cross-section or of substantially elliptical cross-section. In particularly preferred embodiments, the combustible heat source may be a substantially cylindrical combustible heat source of substantially circular cross-section.

The combustible heat source may be preferably a blind combustible heat source. As used herein, the term 'blind' describes a heat source that does not comprise any air flow channels that provide inhalation air to the aerosol-forming substrate. In a blind combustible heat source, heat transfer from the blind combustible heat source to the aerosol-forming substrate occurs primarily by conduction and heating of the aerosol-forming substrate by forced convection is minimized or reduced. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user. By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimized or reduced. The inclusion of a blind combustible heat source may also advantageously substantially prevent or inhibit combustion and decomposition products and other materials formed during ignition and combustion of the blind combustible heat source from entering air drawn through the aerosol generating article during use thereof.

The combustible heat source may comprise at least one longitudinal airflow channel, which provides one or more inhalation airflow pathways through the heat source to the aerosol-forming substrate. This inhalation airflow channel may extend along the length of the heat source through which air may be drawn through the aerosol generating article for inhalation by a user. Such heat sources including one or more longitudinal inhalation airflow channels are referred to herein as "non-blind" heat sources.

The aerosol-forming substrate comprises at least one aerosol-former and a material capable of releasing volatile compounds in response to heating. The aerosol-forming substrate may comprise other additives and ingredients including, but not limited to, humectants, flavourants, binders and mixtures thereof. Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the aerosol generating article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in aerosol generating articles herein are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenized plant-based material. For example, the aerosol-forming substrate may comprise one or more materials derived from plants including, but not limited to: tobacco; tea, for example green tea; peppermint; laurel; eucalyptus; basil; sage; verbena; and tarragon. Preferably, the material capable of emitting volatile compounds in response to heating may be a charge of tobacco-based material, most preferably a charge of homogenized tobacco-based material.

The aerosol-forming substrate may be in the form of a plug or segment comprising a material capable of emitting volatile compounds in response to heating circumscribed by a paper or other wrapper. As stated above, where an aerosol-forming substrate may be in the form of such a plug or segment, the entire plug or segment including any wrapper may be considered to be the aerosol-forming substrate. The aerosol-forming substrate preferably has a length of between about 5 mm and about 20 mm. In certain embodiments, the aerosol-forming substrate may have a length of between about 6 mm and about 15 mm or a length of between about 7 mm and about 12 mm. In preferred embodiments, the aerosol-forming substrate comprises a plug of tobacco-based material wrapped in a plug wrap. In particularly preferred embodiments, the aerosol-forming substrate comprises a plug of homogenized tobacco-based material wrapped in a plug wrap.

Aerosol generating or smoking articles described herein may comprise one or more air inlets around the periphery of the aerosol-forming substrate. In such embodiments, in use, cool air may be drawn into the aerosol-forming substrate of the aerosol generating article through the air inlets. The air drawn into the aerosol-forming substrate through the air inlets passes downstream through the aerosol generating article from the aerosol-forming substrate and exits the aerosol generating article through the mouthpiece or proximal end thereof.

In such embodiments, during puffing by a user the cool air drawn through the one or more air inlets around the periphery of the aerosol-forming substrate advantageously reduces the temperature of the aerosol-forming substrate. This advantageously substantially prevents or inhibits spikes in the temperature of the aerosol-forming substrate during puffing by a user. As used herein, the term 'cool air' may be used to describe ambient air that may be not significantly heated by the combustible heat source upon puffing by a user.

Aerosol generating or smoking articles described herein may comprise a heat-conducting element around and in direct contact with both at least a rear portion of the heat source and at least a front portion of the aerosol-forming substrate. The heat-conducting element provides a thermal link between the combustible heat source and the aerosol-forming substrate and advantageously helps to facilitate adequate heat transfer from the combustible heat source to the aerosol-forming substrate to provide an acceptable aerosol. Preferably the heat-conducting element forms at least a portion of the inner tubular member described herein. Suitable heat-conducting elements for use herein include, but are not limited to: metal foil wrappers such as, for example, aluminum foil wrappers, steel wrappers, iron foil wrappers and copper foil wrappers; and metal alloy foil wrappers.

Aerosol generating or smoking articles described herein preferably comprise a mouthpiece located at the proximal end thereof. Preferably, the mouthpiece may be of low filtration efficiency, more preferably of very low filtration efficiency. The mouthpiece may be a single segment or component mouthpiece. Alternatively, the mouthpiece may be a multi-segment or multi-component mouthpiece. The filter element may form at least a portion of the mouthpiece.

The mouthpiece may comprise a filter element comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Aerosol generating or smoking articles described herein preferably further comprise a transfer element (diffuser element) or spacer element between the aerosol-forming substrate and the mouthpiece. The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of the aerosol generating article to be adjusted to a desired value, for example to a length similar to that of a conventional cigarette, through an appropriate choice of the length of the transfer element. In addition, the length of the spacer or transfer element may define the distance the heat source may retract.

The transfer element may have a length of between about 7 mm and about 50 mm, for example a length of between about 10 mm and about 45 mm or of between about 15 mm and about 30 mm. The transfer element may have other lengths depending upon the desired overall length of the aerosol generating article, and the presence and length of other components within the aerosol generating article.

Preferably, the transfer element comprises at least one open-ended tubular hollow body. In such embodiments, in use, air drawn into the aerosol generating article passes through the at least one open-ended tubular hollow body as it passes downstream through the aerosol generating article from the aerosol-forming substrate to the mouthpiece. The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, aerosol generating articles described herein may comprise an aerosol-cooling element or heat exchanger between the aerosol-forming substrate and the mouthpiece. The aerosol-cooling element may comprise a plurality of longitudinally extending channels. The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil. Preferably the aerosol-cooling element may comprise a gathered sheet of biodegradable polymeric material, such as polylactic acid (PLA) or a grade of Mater-Bi® (a commercially available family of starch based copolyesters).

The aerosol generating or smoking article may be substantially cylindrical in shape. The aerosol generating or smoking article may be substantially elongate. The aerosol generating or smoking article has a length and a circumference substantially perpendicular to the length. The aerosol-forming substrate may be substantially cylindrical in shape. The aerosol-forming substrate may be substantially elongate. The aerosol-forming substrate also has a length and a circumference substantially perpendicular to the length.

The aerosol generating or smoking article may have any desired length in the extended position. For example, the aerosol generating or smoking article in the extended position may have a total length of between approximately 60 mm and approximately 100 mm, or from about 65 mm to about 80 mm, or about 70 mm.

The aerosol generating or smoking article may have any desired length in the retracted position. For example, the aerosol generating or smoking article in the retracted position may have a total length of between approximately 40 mm and approximately 70 mm, or from about 40 mm to about 60 mm, or about 50 mm.

The aerosol generating or smoking article may have any desired external diameter. For example, the aerosol generating or smoking article may have an external diameter of between approximately 5 mm and approximately 12 mm.

All scientific and technical terms used herein have meanings commonly used in the art unless otherwise specified. The definitions provided herein are to facilitate understanding of certain terms used frequently herein.

The terms "upstream" and "downstream" refer to relative positions of elements of the aerosol generating article described in relation to the direction of inhalation air flow as it is drawn through the body of the aerosol generating article from a distal portion to the mouthpiece portion. In other words, as used herein, "downstream" is defined relative to air flow during use of the smoking article or aerosol generating article, with the mouth end of the article being the downstream end through which air and aerosol is drawn by the user. The end opposite the mouth end is the upstream end.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Figure 1:
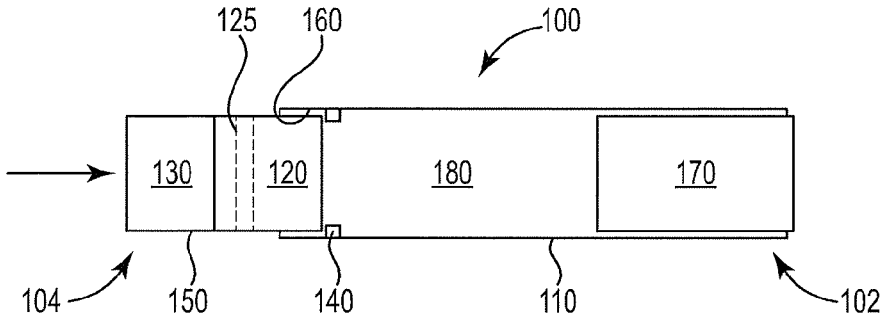
FIG. 1 is schematic diagram of illustrative aerosol generating article 100 in the extended position.

The schematic drawings are not necessarily to scale and are presented for purposes of illustration and not limitation. The drawings depict one or more aspects described in this disclosure. However, it will be understood that other aspects not depicted in the drawing fall within the scope and spirit of this disclosure.

Figure 2:
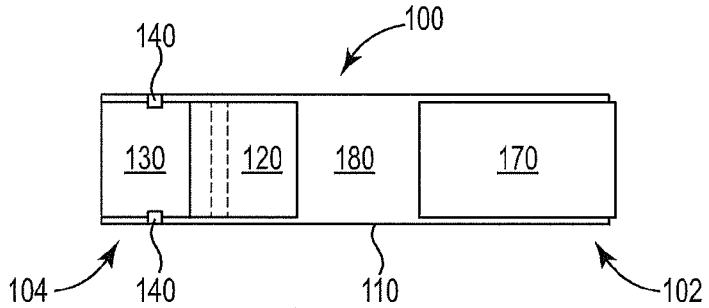
FIG. 2 is a schematic diagram of the illustrative aerosol generating article 100 of FIG. 1 in the retracted position.
Figure 8:
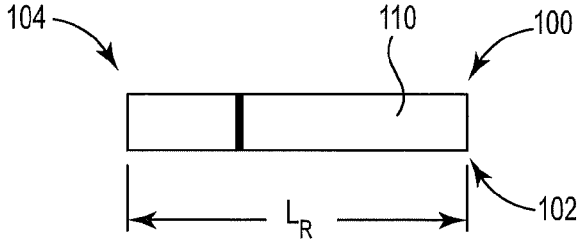
FIG. 8 is a perspective view of the aerosol generating article 100 of FIG. 7 in the retracted position.

An aerosol generating article 100 extends between a proximal end 102 and a distal end 104. A tubular body 110 is positioned at the proximal end 102 of the aerosol generating article 100 and extends toward the distal end 104. A combustible heat source 130 is positioned at the distal end 104 of the aerosol generating article 100. An aerosol generating substrate 120 is downstream of the combustible heat source 130. The combustible heat source 130 is slideable from an extended position (FIG. 1 and FIG. 3 and FIG. 5 and FIG. 6 and FIG. 7) to a retracted position (FIG. 2 and FIG. 4 and FIG. 8) having a shorter article length. The arrows indicate a force applied to the combustible heat source 130 and the resulting direction of movement of the combustible heat source 130. The combustible heat source 130 at least partially retracts into the tubular body 110 in the retracted position. Preferably the entire length of the combustible heat source 130 retracts into the tubular body 110 in the retracted position.

An inner surface 160 of the tubular body 110 may comprise a heat reactive material, as described above. Preferably the heat reactive material is disposed on or forms a portion of the inner surface 160 along a distal end portion of the tubular body 110. The heat reactive material may facilitate extinguishment of the retracted combustible heat source 130.

Figure 5:
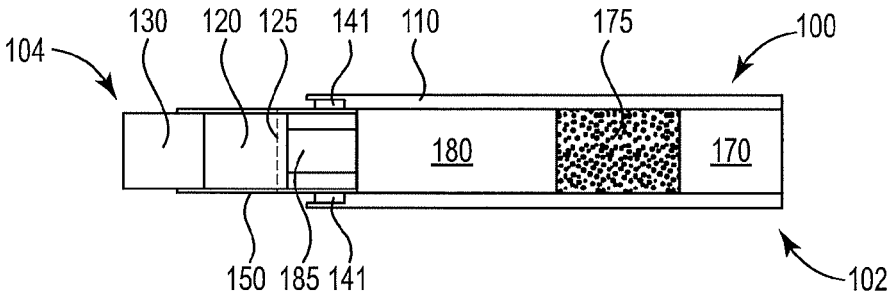
FIG. 5 is a schematic diagram of another illustrative aerosol generating article 100 in the extended position.
Figure 6:
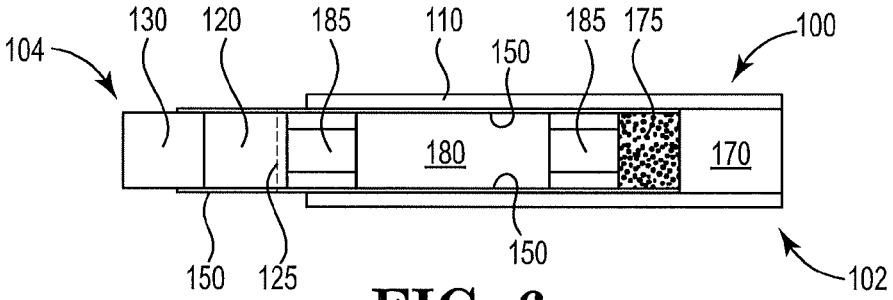
FIG. 6 is a schematic diagram of another illustrative aerosol generating article 100 in the extended position.
Figure 7:
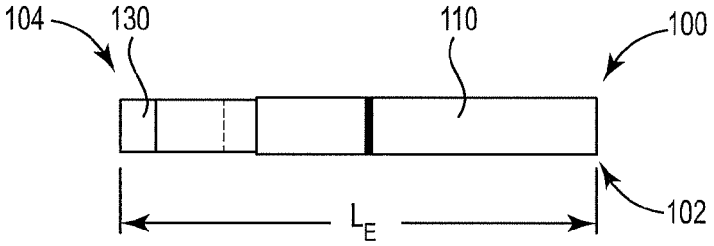
FIG. 7 is perspective view of an illustrative aerosol generating article 100 in the extended position.

An aerosol-forming substrate 120 is downstream of the distal end 104 and the combustible heat source 130. In many embodiments an inner tubular element 150 holds the combustible heat source 130. The combustible heat source 130 may be cylindrical. The inner tubular element 150 is at least partially disposed within a distal end of the tubular body 110 and the inner tubular element 150 is slideable from the extended position to the retracted position. In the illustrated embodiment, the aerosol-forming substrate 120 is at least partially disposed within the inner tubular element 150 and is slideable from the extended position to the retracted position. Thus, the combustible heat source 130 may be fixed to the aerosol-forming substrate 120 via the inner tubular element 150. The inner tubular element 150 may also facilitate heat transfer from the combustible heat source 130 to the aerosol-forming substrate 120. Perforations or apertures 125 may provide inhalation or inlet air that passes through the heated aerosol-forming substrate 120. The inner tubular element 150 may also contain or hold a diffuser or transfer element 185 (as shown in FIG. 5 and FIG. 6).

The aerosol generating article 100 may further include a void space 180 and a filter element 170 in sequential, abutting coaxial alignment with the combustible heat source 130 and aerosol-forming substrate 120. A diffuser or transfer element 185 may be disposed in a portion of the void space 180. An aerosol cooling element 175 may be disposed in a portion of the void space 180. The aerosol cooling element 175 may be upstream of a mouthpiece filter element 170 and abut the mouthpiece filter element 170. The filter element 170 may include or form a portion of the mouthpiece end 102.

The aerosol generating article 100 may have a length and diameter similar to a conventional cigarette. The aerosol generating article 100 may have an extended length LE (in the extended position) in a range from about 60 mm to about 100 mm, or from about 70 mm to about 90 mm, or about 70 to about 80 mm. The aerosol generating article 100 may have a retracted length $L_R$ (in the retracted position) in a range from about 40 mm to about 70 mm, or from about 40 mm to about 60 mm, or about 50 mm.

The combustible heat source 130 and aerosol-forming substrate 120 may have a combined length in a range from about 15 mm to about 20 mm' The filter element 170 may have a length in a range from about 10 mm to about 25 mm. The void space 180 may have a length from about 20 mm to about 50 mm, or from about 25 mm to about 40 mm.

An optional detent element 140 or ridge or rib element may be configured to engage the inner tubular member 150 and maintain the extended position until sufficient force may be applied to the inner tubular body 150 to overcome the detent element 140 and retracts the combustible heat source 130 into the tubular body 110. An optional adhesive 141 may be configured to adhere the inner tubular member 150 to the tubular member 110 and maintain the extended position until heat from the combusting heat source melts the adhesive 141 and sufficient force is applied to the inner tubular body 150 to overcome the heated adhesive 141 and retracts the combustible heat source entirely 130 into the tubular body 110. The detent element 140 and adhesive 141 are referred to above as retention elements.

Figure 3:
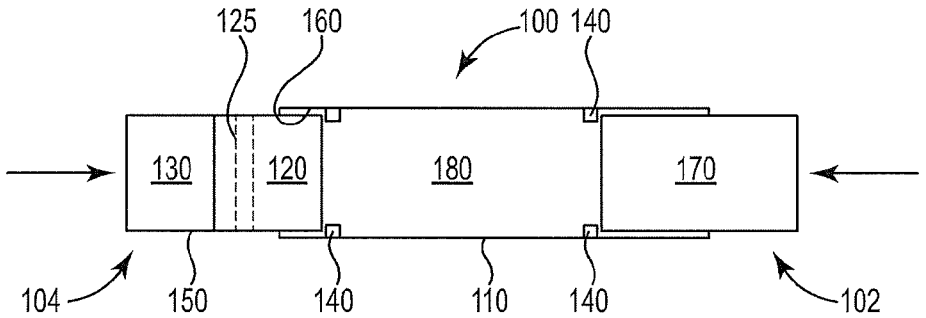
FIG. 3 is schematic diagram of another illustrative aerosol generating article 100 in the extended position.
Figure 4:
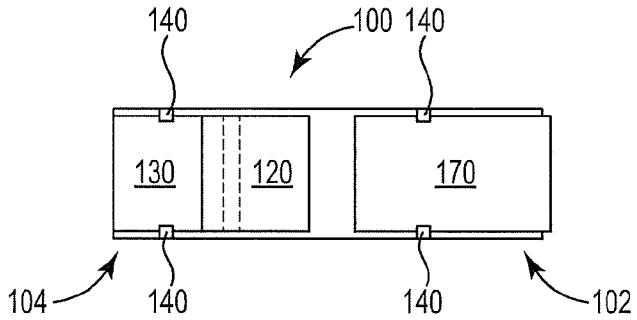
FIG. 4 is a schematic diagram of the illustrative aerosol generating article 100 of FIG. 3 in the retracted position.

As illustrated in FIG. 3 and FIG. 4, the filter element 170 may be partially disposed within the proximal end of the tubular body 110 and an exposed portion extends beyond the proximal end of the tubular body 110. The filter element 170 is slideable from an extended filter position (FIG. 3) to a retracted filter position (FIG. 4) and the filter element 170 at least partially retracts into the tubular body 110 in the retracted position. An optional detent element 140 or ridge or rib element may be configured to engage the filter element 170 and maintain the extended position until sufficient force is applied to the filter element 170 to overcome the detent element 140 and retracts the filter element 170 into the tubular body 110. The filter element 170 may include cellulose acetate tow.

The aerosol-generating substrate 120 may be located immediately adjacent to or downstream of the combustible heat source 130 and comprises a cylindrical plug of homogenized tobacco material comprising, for example, glycerine as an aerosol former and may be circumscribed by a plug wrap. A heat-conducting element or inner tubular member 150, surrounds and may be in contact with a rear portion of the combustible heat source 130 and an abutting front portion of the aerosol-generating substrate 120.

FIG. 5 illustrates the aerosol cooling element 175 upstream of and abutting the mouthpiece filter element 170. FIG. 5 illustrates the diffuser or transfer element 185 downstream of and abutting the aerosol-forming substrate 120. The diffuser or transfer element 185 may be slidable with the combustible heat source 130. The diffuser or transfer element 185 may be contained within the inner tubular member 150. The diffuser or transfer element 185 may be contained within the inner tubular member 150 and may be slidable with the combustible heat source 130 and the aerosol-forming substrate 120. The void space 180 may be eliminated once the aerosol generating article 100 is positioned in the retracted position. A retention element may be placed at a junction of the tubular body 110 and the inner tubular member 150. This retention member may be an adhesive 141, as illustrated or an outer wrapper that overwrap a junction of the tubular body 110 with the inner tubular element 150 and is fixed to both the tubular body 110 and the inner tubular element 150 by, for example an adhesive.

The void space 180 may be about 15 mm to about 25 mm, or about 20 mm in length and the void space 180 separates the aerosol cooling element 175 from the diffuser or transfer element 185. The overall length of the aerosol generating article 100 of FIG. 5 may be about 50 mm to about 100 mm, or about 60 mm to about 80 mm, or about 70 mm in the extended position and about 30 mm to about 70 mm, or about 40 mm to about 60 mm, or about 50 mm in the retracted position. The length of the combustible heat source 130 may be about 5 mm to about 15 mm, or 7 mm to about 11 mm, or about 9 mm or about 10 mm. The length of the aerosol-forming substrate 120 may be about 5 mm to about 15 mm, or 6 mm to about 10 mm, or about 8 mm or about 9 mm. The length of the diffuser or transfer element 185 may be about 5 mm to about 15 mm, or 7 mm to about 11 mm, or about 9 mm or about 10 mm. The length of the aerosol cooling element 175 may be about 7 mm to about 17 mm, or 10 mm to about 14 mm, or about 11 mm or about 12 mm. The length of the mouthpiece filter element 170 may be about 7 mm to about 17 mm, or 10 mm to about 14 mm, or about 11 mm or about 12 mm.

FIG. 6 illustrates the aerosol cooling element 175 upstream of and abutting the mouthpiece filter element 170. FIG. 6 illustrates a first diffuser or transfer element 185 downstream of and abutting the aerosol-forming substrate 120 and a second diffuser or transfer element 185 upstream of and abutting the aerosol cooling element 175. The diffuser or transfer element 185 may be slidable with the combustible heat source 130. An inner tubular member 150 may extend along and within a substantial portion or length of the tubular body 110. The inner tubular member 150 may be co-axial with the tubular body 110.

An inner tubular member 150 may extend from the combustible heat source 130 to the aerosol cooling element 175 or to the mouthpiece filter element 170. The diffuser or transfer elements 185, aerosol cooling element 175, and the mouthpiece filter element 170 may be contained within or held by the inner tubular member 150. The inner tubular member 150 may have an area of weakness to allow the inner tubular member 150 to collapse within the tubular body 110 and retract into the retracted position (see FIG. 8). The area of weakness may be located coextensive with the void space 180.

The diffuser or transfer element 185 and aerosol-forming substrate 120 may be contained within the inner tubular member 150 and may be slidable with the combustible heat source 130. The diffuser or transfer element 185 may abut or contact the second diffuser or transfer element 185 when positioned in the retracted position. The void space 180 may be eliminated once the aerosol generating article 100 is collapsed into the retracted position. An optional retention element may be placed at a junction of the tubular body 110 and the inner tubular member 150. This retention member may be an adhesive or an outer wrapper that overwrap a junction of the tubular body 110 with the inner tubular element 150 and is fixed to both the tubular body 110 and the inner tubular element 150 by, for example an adhesive.

The void space 180 may be about 15 mm to about 25 mm, or about 20 mm in length and the void space 180 separates the first and second diffuser or transfer elements 185. The overall length of the aerosol generating article 100 of FIG. 6 may be about 50 mm to about 100 mm, or about 60 mm to about 80 mm, or about 70 mm in the extended position and about 30 mm to about 70 mm, or about 40 mm to about 60 mm, or about 50 mm in the retracted position. The length of the combustible heat source 130 may be about 5 mm to about 15 mm, or 7 mm to about 11 mm, or about 9 mm or about 10 mm. The length of the aerosol-forming substrate 120 may be about 5 mm to about 15 mm, or 6 mm to about 10 mm, or about 8 mm or about 9 mm. The length of each of the first and second diffuser or transfer element 185 each may each be about 4 mm to about 10 mm, or 5 mm to about 9 mm, or about 7 mm or about 8 mm. The length of the aerosol cooling element 175 may be about 5 mm to about 15 mm, or 8 mm to about 12 mm, or about 10 mm. The length of the mouthpiece filter element 170 may be about 5 mm to about 15 mm, or 7 mm to about 11 mm, or about 9 mm or about 10 mm.

In use, the user ignites the combustible heat source 130 which heats the aerosol-forming substrate 120 to produce an aerosol. When the user inhales on the mouthpiece 102 air may be drawn through the aerosol-forming substrate 120 through air inlet holes 125 in the inner tubular member 150 or tubular body 110 and adjacent to the aerosol-forming substrate 120, through the expansion or void 180, through the filter element 170 to the consumer.

Once consumption of the aerosol-generating substrate 120 is complete, the consumer may apply a force to the combustible heat source 130 and the inner tubular body 150 to overcome the retention element or the inner tubular member area of weakness and retract the combustible heat source 130 into the tubular body 110. Once the combustible heat source 130 retracts into the tubular body 110, the optional heat reactive material 160 may function to seal the combustible heat source 130 within the tubular body 110. In addition, the consumer may also apply a force to the filter element 170 to overcome the retention element 140 (if present) and retracts the filter element 170 into the tubular body 110, when the filter element 170 may be slidable relative to the tubular body 110. Retraction of the combustible heat source 130 within the tubular body 110 extinguishes the combustible heat source 130.

The invention claimed is:

1. An aerosol generating article having a proximal end and a distal end, comprising:

a tubular body positioned at the proximal end of the aerosol generating article and extending toward the distal end;

a combustible heat source positioned at the distal end of the aerosol generating article, wherein the combustible heat source is a carbonaceous heat source; and an aerosol-forming substrate downstream of, and separate from, the combustible heat source;

the combustible heat source is slideable from an extended position having a first article length to a retracted position having a second article length that is less than the first article length in response to force applied to the combustible heat source in a direction along a longitudinal axis of the combustible heat source and the entire length of the combustible heat source retracts into the tubular body in the retracted position.

2. The aerosol generating article according to claim 1, wherein the tubular body comprises a retention element that maintains the extended position until sufficient force overcomes the retention element and retracts the combustible heat source into the tubular body to the retracted position.

3. The aerosol generating article according to claim 2, further comprising an inner tubular element holding the combustible heat source, the inner tubular element at least partially disposed within a distal end of the tubular body and the inner tubular element is slideable from the extended position to the retracted position.

4. The aerosol generating article according to claim 3, wherein the retention element comprises an outer wrapper that overwrap a junction of the tubular body with the inner tubular element and is fixed to both the tubular body and the inner tubular element.

5. The aerosol generating article according to claim 1, further comprising an inner tubular element holding the combustible heat source, the inner tubular element at least partially disposed within a distal end of the tubular body and the inner tubular element is slideable from the extended position to the retracted position.

6. The aerosol generating article according to claim 5, wherein the aerosol-forming substrate is at least partially disposed within the inner tubular element and is slideable from the extended position to the retracted position.

7. The aerosol generating article according to claim 5, wherein the carbonaceous heat source, aerosol-forming substrate and a first transfer element are contained within the inner tubular element.

8. The aerosol generating article according to claim 7, wherein a second transfer element is contained within the tubular body and separated from the first transfer element by a void space in the extended position.

9. The aerosol generating article according to claim 1, further comprising a filter element disposed within a proximal end of the tubular body.

10. The aerosol generating article according to claim 9, wherein the filter element is partially disposed within the proximal end of the tubular body and an exposed portion extends beyond the proximal end of the tubular body.

11. The aerosol generating article according to claim 10, wherein the filter element is slideable from an extended filter position to a retracted filter position and the filter element at least partially retracts into the tubular body in the retracted position.

12. The aerosol generating article according to claim 1, wherein the tubular body contains a transfer element and an aerosol cooling element.

13. The aerosol generating article according to claim 1, wherein the second article length is about 90% or less than the first article length.

14. The aerosol generating article according to claim 1, wherein the proximal end of the tubular body comprises a mouthpiece and a filter element.

15. The aerosol generating article according to claim 1, wherein the tubular body has an inner surface that comprises a heat reactive material that is configured to deform in response to heat from the combustible heat source in the retracted position, such that the tubular body fits tightly against the combustible heat source.

16. The aerosol generating article according to claim 15, wherein the reactive material comprises an intumescent material.

17. The aerosol generating article according to claim 15, wherein the reactive material comprises a heat-shrink material that is configured to at least partially seal around the combustible heat source.

18. The aerosol generating article according to claim 1, wherein the tubular body is lined with non-combustible material being at least one of: a metal; a metal oxide; a ceramic; graphite; or stone.

19. The aerosol generating article according to claim 1, wherein the tubular body comprises an adhesive that maintains the extended position until sufficient heat and force overcomes the adhesive and retracts the combustible heat source into the tubular body to the retracted position.

20. The aerosol generating article according to claim 1, wherein the aerosol-forming substrate comprises tobacco.

* * * * *